US012232522B2

(12) United States Patent
Bruton et al.

(10) Patent No.: US 12,232,522 B2
(45) Date of Patent: Feb. 25, 2025

(54) METHOD OF GENERATING AN AEROSOL HAVING PROTONATED NICOTINE

(71) Applicant: NICOVENTURES TRADING LIMITED, London (GB)

(72) Inventors: Connor Bruton, London (GB); Anna Azzopardi, London (GB); Peter Clayton, London (GB)

(73) Assignee: NICOVENTURES TRADING LIMITED, London (GB)

( * ) Notice: Subject to any disclaimer, the term of this patent is extended or adjusted under 35 U.S.C. 154(b) by 742 days.

(21) Appl. No.: 17/293,934

(22) PCT Filed: Nov. 15, 2019

(86) PCT No.: PCT/GB2019/053233
§ 371 (c)(1),
(2) Date: May 14, 2021

(87) PCT Pub. No.: WO2020/099880
PCT Pub. Date: May 22, 2020

(65) Prior Publication Data

US 2022/0007715 A1 Jan. 13, 2022

(30) Foreign Application Priority Data

Nov. 16, 2018 (GB) ..... 1818711

(51) Int. Cl.
*A24F 40/10* (2020.01)
*A24B 15/167* (2020.01)
(Continued)

(52) U.S. Cl.
CPC ..... *A24F 40/10* (2020.01); *A24B 15/167* (2016.11); *A24F 40/30* (2020.01); *A24F 40/42* (2020.01)

(58) Field of Classification Search
None
See application file for complete search history.

(56) References Cited

U.S. PATENT DOCUMENTS 10,212,964 B2 2/2019 Karles et al.
2006/0018840 A1* 1/2006 Lechuga-Ballesteros ..... A01N 43/40 514/343

(Continued)

FOREIGN PATENT DOCUMENTS

CA 2910549 C 6/2022
KR 101208473 12/2012

(Continued)

OTHER PUBLICATIONS

KR101208473B1 English Translation obtained from Espacenet, pp. 1-16 (Year: 2024) (Year: 2024).*

(Continued)

*Primary Examiner* — Philip Y Louie
*Assistant Examiner* — Virginia R Bieger
(74) *Attorney, Agent, or Firm* — WOMBLE BOND DICKINSON (US) LLP; Mark R. DeLuca

(57) ABSTRACT

A method of generating an aerosol comprising protonated nicotine, the method comprising the steps of: (i) providing a nicotine formulation comprising nicotine as free base; (ii) providing a carbon dioxide source capable of providing carbon dioxide in situ; (iii) vaporizing or aerosolizing the nicotine formulation; (iv) providing carbon dioxide from the carbon dioxide source, and (v) contacting the carbon dioxide with the vaporized or aerosolized nicotine formulation to thereby protonate nicotine free base and generate an aerosol comprising protonated nicotine.

12 Claims, 4 Drawing Sheets

(51) Int. Cl.
*A24F 40/30* (2020.01)
*A24F 40/42* (2020.01)

(56) References Cited

U.S. PATENT DOCUMENTS

| | | | |
|---|---|---|---|
| 2008/0241255 | A1 | 10/2008 | Rose et al. |
| 2009/0044816 | A1 | 2/2009 | Rasouli et al. |
| 2016/0044960 | A1 | 2/2016 | O'Connor |
| 2018/0007951 | A1 | 1/2018 | Karles et al. |
| 2019/0261672 | A1* | 8/2019 | Chaparro Leal ..... C07D 401/04 |

FOREIGN PATENT DOCUMENTS

| | | | |
|---|---|---|---|
| KR | 101208473 | B1 * | 12/2012 |
| KR | 20160119459 | A | 10/2016 |
| KR | 20160199459 | | 10/2016 |
| WO | 2008121610 | A1 | 10/2008 |
| WO | WO2010107613 | | 9/2010 |
| WO | 2011034723 | A1 | 3/2011 |
| WO | 2014139611 | A1 | 9/2014 |
| WO | 2014140320 | A1 | 9/2014 |
| WO | 2015000974 | A1 | 1/2015 |
| WO | 2015038981 | A2 | 3/2015 |
| WO | 2015091258 | A1 | 6/2015 |
| WO | 2015197627 | A1 | 12/2015 |
| WO | 2016071705 | A1 | 5/2016 |
| WO | 2016071706 | A1 | 5/2016 |
| WO | 2017029268 | A1 | 2/2017 |
| WO | 2017029269 | A1 | 2/2017 |
| WO | 2017029270 | A1 | 2/2017 |
| WO | WO2017051017 | | 3/2017 |
| WO | 2018227275 | A1 | 12/2018 |

OTHER PUBLICATIONS

International Search Report and Written Opinion for PCT/GB2019/053233 date mailed Mar. 6, 2020.

Clayton, P.M., et al., Spectroscopic investigations into the acid-base properties of nicotine at different temperatures, Analytical Methods, 2013, vol. 5, pp. 81-88.

Duell, A.K., et al., Free-Base Nicotine Determination in Electronic Cigarette Liquids by $^{1}$H NMR Spectroscopy, Chemical Research in Toxicology, 2018, vol. 31, pp. 431-434. doi: 10.1021/acs.chemrestox.8b00097.

El-Hellani, A, et al., Quantification of free-base and protonated nicotine in electronic cigarette liquids and aerosol emissions, Chemical Research in Toxicology, Aug. 17, 2015, 28(8), pp. 1532-1537, doi:10.1021/acs.chemrestox.5b00107.

* cited by examiner

METHOD OF GENERATING AN AEROSOL HAVING PROTONATED NICOTINE

PRIORITY CLAIM

The present application is a National Phase entry of PCT Application No. PCT/GB2019/053233, filed Nov. 15, 2019, which claims priority from GB Patent Application No. 1818711.2, filed Nov. 16, 2018, each of which is hereby fully incorporated herein by reference.

FIELD OF THE INVENTION

The present disclosure relates to a method of generating an aerosol comprising protonated nicotine, nicotine delivery systems, containers in which are contained nicotine formulations and to electronic vapor provision systems such as electronic nicotine delivery systems (e.g. e-cigarettes) incorporating said formulation.

BACKGROUND TO THE INVENTION

Electronic vapor provision systems such as e-cigarettes generally contain a reservoir of liquid which is to be vaporized, typically containing nicotine. When a user inhales on the device, a heater is activated to vaporize a small amount of liquid, which is therefore inhaled by the user as a nicotine containing aerosol.

The use of e-cigarettes in the UK has grown rapidly, and it has been estimated that there are now over a million people using them in the UK.

One challenge faced in providing such systems is to provide from the vapor provision device a vapor to be inhaled which provides consumers with an acceptable experience. Some consumers may prefer an e-cigarette that generates an aerosol that closely 'mimics' smoke inhaled from a tobacco product such as a cigarette. Aerosols from e-cigarettes and smoke from tobacco products such as cigarettes provides to the user a complex chain of flavor in the mouth, nicotine absorption in the mouth, throat and upper respiratory tract, followed by pulmonary nicotine absorption. These various aspects are described by users in terms of flavor, intensity/quality, impact, irritation/smoothness and nicotine reward. Nicotine contributes to a number of these factors, and is strongly associated with factors such as impact, irritation and smoothness; these are readily perceived by consumers, and e-cigarettes may offer too much or too little of these parameters for consumers, depending upon individual preferences. Nicotine reward is particularly complex as it results from both the amount of and speed with which nicotine is absorbed in the mouth, throat and upper respiratory tract, and from the amount and speed nicotine that is absorbed from the lungs. In general, pulmonary nicotine absorption will be of greater significance in the delivery of nicotine to the central nervous system and the activation of nicotine sensitive receptors within. Each of these factors, and their balance, can strongly contribute to consumer acceptability of an e-cigarette. Providing means to optimize the overall vaping experience is therefore desirable to e-cigarette manufacturers.

SUMMARY OF THE INVENTION

In one aspect there is provided a method of generating an aerosol comprising protonated nicotine, the method comprising the steps of: (i) providing a nicotine formulation comprising nicotine as free base; (ii) providing a carbon dioxide source capable of providing carbon dioxide in situ; (iii) vaporizing or aerosolizing the nicotine formulation; (iv) providing carbon dioxide from the carbon dioxide source, and (v) contacting the carbon dioxide with the vaporized or aerosolized nicotine formulation to thereby protonate nicotine free base and generate an aerosol comprising protonated nicotine.

In one aspect there is provided a nicotine delivery system comprising (i) a nicotine formulation comprising nicotine; and (ii) a carbon dioxide precursor capable of forming carbon dioxide, wherein the carbon dioxide precursor is an electrolyte.

In one aspect there is provided a nicotine delivery system comprising (i) a nicotine formulation comprising nicotine; and (ii) a carbon dioxide precursor capable of forming carbon dioxide; wherein the carbon dioxide precursor is a couple of (a) one or more carbonate salts, one or more hydrogen carbonate salts or a mixture thereof; and (b) one or more acids.

In one aspect there is provided a nicotine delivery system comprising (i) a nicotine formulation comprising nicotine; and (ii) a carbon dioxide precursor capable of forming carbon dioxide; wherein the carbon dioxide precursor is selected from a carbonate, hydrogen carbonate or mixture thereof that thermally degrades to form carbon dioxide.

In one aspect there is provided a nicotine delivery system comprising (i) a nicotine formulation comprising nicotine; and (ii) a carbon dioxide source that comprises carbon dioxide in the solid, liquid or gas phase.

In one aspect there is provided a nicotine delivery system comprising (i) a nicotine formulation comprising nicotine; and (ii) a carbon dioxide source that comprises carbon dioxide in the liquid or gas phase.

In one aspect there is provided a contained nicotine formulation comprising (a) one or more containers; and (b) a nicotine delivery system as defined herein.

In one aspect there is provided an electronic vapor provision system comprising: a nicotine delivery system as defined herein; a vaporize r for vaporizing the nicotine formulation for inhalation by a user of the electronic vapor provision system; a power supply comprising a cell or battery for supplying power to the vaporize r.

In one aspect there is provided an electronic vapor provision system comprising (a) a nicotine delivery system comprising (i) a nicotine formulation comprising nicotine; and (ii) a carbon dioxide source that comprises carbon dioxide in the solid, liquid or gas phase; (b) a vaporize r for vaporizing the nicotine formulation for inhalation by a user of the electronic vapor provision system; a power supply comprising a cell or battery for supplying power to the vaporize r.

In one aspect there is provided an electronic vapor provision system comprising (a) a nicotine delivery system comprising (i) a nicotine formulation comprising nicotine; and (ii) a carbon dioxide source that comprises carbon dioxide in the liquid or gas phase; (b) a vaporize r for vaporizing the nicotine formulation for inhalation by a user of the electronic vapor provision system; a power supply comprising a cell or battery for supplying power to the vaporize r.

In one aspect there is provided an electronic vapor provision system comprising (a) a nicotine delivery system comprising (i) a nicotine formulation comprising nicotine; and (ii) a container of compressed carbon dioxide; (b) a vaporize r for vaporizing the nicotine formulation for inhalation by a user of the electronic vapor provision system; a power supply comprising a cell or battery for supplying power to the vaporize r.

In one aspect there is provided use of carbon dioxide for improving sensory properties of a vaporized nicotine formulation.

In one aspect there is provided use of carbon dioxide for reducing the amount of gas phase nicotine produced in an aerosol by a vaporized nicotine formulation.

BRIEF DESCRIPTION OF THE DRAWINGS

The present disclosure will now be described in further detail by way of example only with reference to the accompanying figure in which:

In FIG. 1: A—source of electrical power; B—e-liquid storage reservoir; C—aerosol generation unit; D—electrolyte storage reservoir; E—electrodes; F—gas permeable barrier (allows ingress of carbon dioxide gas); G—zone of mixing; H—mouthpiece; and I—exit orifice for aerosol.

FIG. 2 shows an embodiment of the disclosure wherein the nicotine containing aerosol is produced from an aerosol generation unit whereby a nicotine containing aerosol was formed thermally. In FIG. 2: A—source of electrical power; B—E-liquid storage reservoir; C—aerosol generation unit; D—storage reservoir of compressed carbon dioxide; E—controlled pressure release valve; F—carbon dioxide release void at atmospheric pressure; G—gas permeable barrier (allows ingress of carbon dioxide gas); H—zone of mixing; I—exit orifice for aerosol; and J—mouthpiece.

DETAILED DESCRIPTION

Figure 1:
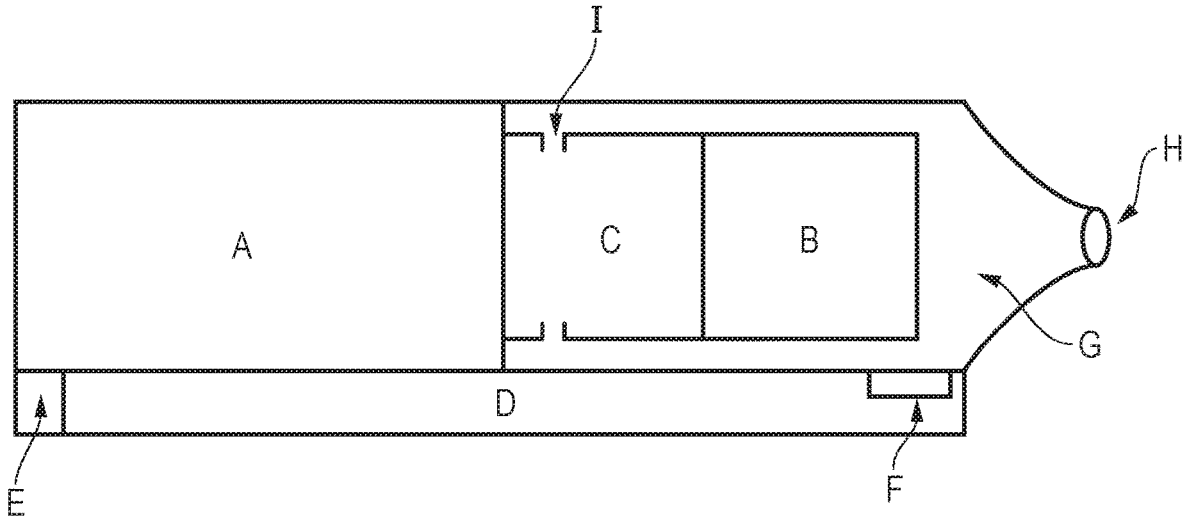
FIG. 1 shows a schematic representation of the electrolytic generation of carbon dioxide, according to certain embodiments of the present disclosure.
Figure 2:
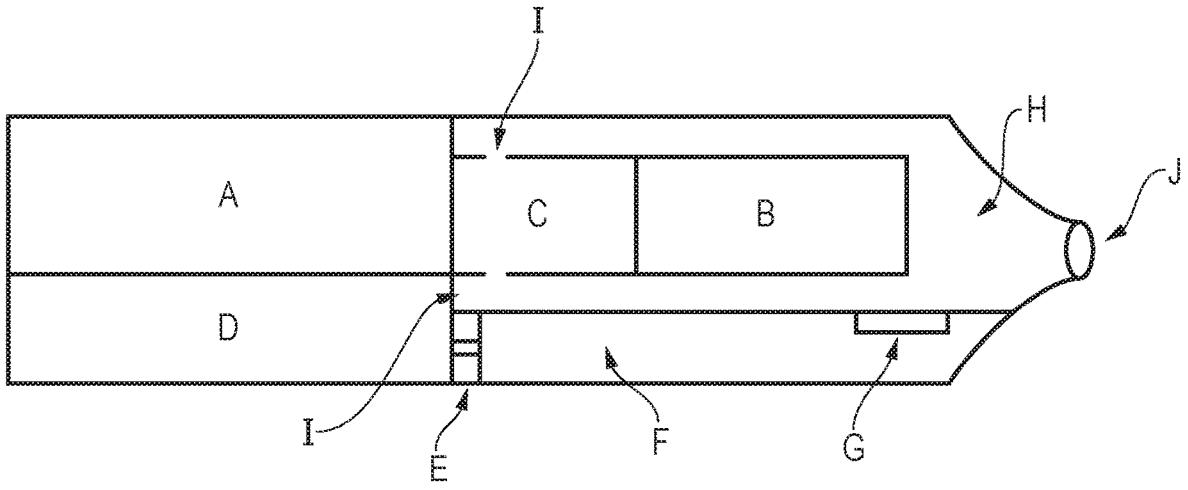
FIG. 2 shows a schematic representation of the compressed carbon dioxide, according to certain embodiments of the present disclosure.

As discussed herein the present disclosure provides a method of generating an aerosol comprising protonated nicotine, the method comprising the steps of: (i) providing a nicotine formulation comprising nicotine as free base; (ii) providing a carbon dioxide source capable of providing carbon dioxide in situ; (iii) vaporizing or aerosolizing the nicotine formulation; (iv) providing carbon dioxide from the carbon dioxide source, and (v) contacting the carbon dioxide with the vaporized or aerosolized nicotine formulation to thereby protonate nicotine free base and generate an aerosol comprising protonated nicotine.

We have found that an advantageous system may be provided in which an aerosol is delivered and in which the aerosol particles are in a gas phase which is rich in carbon dioxide gas. It will be appreciated by one skilled in the art that atmospheric gas contains a proportion of carbon dioxide. By "rich in carbon dioxide" it is meant a gas having a carbon dioxide concentration greater than the concentration of atmospheric carbon dioxide (410 ppm). By "rich in carbon dioxide" it is meant a gas having a carbon dioxide concentration greater than 500 ppm. We have found that by substantially increasing the concentration of carbon dioxide in the gas surrounding the aerosol droplets, improved results may be achieved.

As is understood by one skilled in the art, S-nicotine may exist in unprotonated form, monoprotonated form or diprotonated form. The structures of each of these forms are given below.

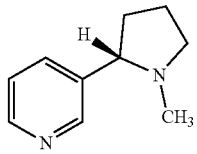

Unprotonated S-nicotine

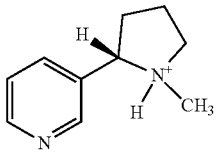

monoprotonated S-nicotine

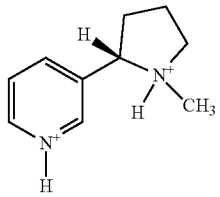

diprotonated S-nicotine

Reference in the specification to protonated form means both monoprotonated nicotine and diprotonated nicotine. Reference in the specification to amounts in the protonated form means the combined amount of monoprotonated nicotine and diprotonated nicotine. Furthermore, when reference is made to a fully protonated formulation it will be understood that at any one time there may be very minor amounts of unprotonated nicotine present, e.g. less than 1% unprotonated.

As will be appreciated by one skilled in the art, carbon dioxide is a proto-acid or acidic or proto acidic gas in the sense that when dissolved in water wherein it can form in-situ carbonic acid ($H_2CO_3$) which is a recognized albeit weak acid (pKal=3.6 at 25° C.). Not all of the dissolved $CO_2$ forms carbonic acid. Carbonic acid is in equilibrium with the dissolved component of carbon dioxide and water. In the method of the present disclosure, the aerosol droplets produced are within an enriched $CO_2$ gas stream to be delivered to a user. We understand that the majority of nicotine being delivered is contained within the droplets in the gas stream. The droplets are modified, and their final properties improved, as there is significant surface area contact between the two phases, namely the gas phase and the aerosol droplets. By virtue of this surface area contact, exchange will occur and some of the $CO_2$ in the gas phase will dissolve within the aerosol liquid particles. As $CO_2$ is a proto-acid, on contact with the liquid, and as mentioned above, carbonic acid will be formed. Carbonic acid will protonate the unprotonated nicotine, to likely form nicotine carbonate and/or nicotine bicarbonate.

The equilibrium between unprotonated and protonated nicotine is affected by $CO_2$. Consequently, the equilibrium of nicotine in the gas phase is also affected. The effect is to reduce the amount of nicotine in the gas phase. Nicotine in the gas phase has negative sensory characteristics and the reduction provided by the present disclosure is a positive modification. This modification confers the user the benefit of being able to reduce the amounts of nicotine in the gas phase which is produced from 'outgassing' of nicotine from the droplets. In some aspects, it is be possible to control the dosage of carbon dioxide and therefore control this described effect. This will allow users to tailor and control the vapor. It is understood that some users may prefer more sensory stimulation (less $CO_2$ gas) and other users may prefer a 'smoother' vapor (more $CO_2$ gas).

Although the amount of gas phase nicotine is very low compared to nicotine present within aerosol droplets, its presence is highly relevant to the user's sensorial experience. This experience will vary between users; higher levels of gas phase nicotine will tend to cause stimulation in the throat area, so called throat catch. If this is too pronounced, the user may perceive it as a negative and consider the experience to be too harsh. However if the sensation is entirely absent, the user may perceive the experience as bland. Consequently, in the art there is a desire to strike a balance between nicotine in the gas phase and nicotine within aerosol droplets. Where the balance lies will vary between users. Frequent users may prefer more stimulation from nicotine in the gas-phase, compared to less experienced 'softer' users who may prefer much less gas-phase nicotine. The use of carbon dioxide gas as a delivery gas, under conditions of measured release, may offer the user individual control. The user may manipulate the flow-volume of $CO_2$ gas release into the aerosol stream. This benefit is a sensorial benefit and does not affect the total amount of nicotine delivered. Only the distribution of nicotine between the gas phase and droplet phase is affected. The protonation of nicotine which predominantly occurs in droplets will hence cause a reduction in gas-phase nicotine.

Therefore, as will be appreciated from the above discussion, the advantages of the disclosure are at least twofold. Firstly, the present disclosure allows for protonation of unprotonated nicotine in a controllable manner. Secondly, the present disclosure provides control between the distribution of nicotine between the gas phase and the droplet phase. An additional benefit is that control may be exercised within a single vaping session permitting the user to change the amount of sensory stimulation on a puff by puff basis.

For ease of reference, these and further aspects of the present disclosure are now discussed under appropriate section headings. However, the teachings under each section are not necessarily limited to each particular section.

Formulation

In one aspect the nicotine formulation further comprises a carrier. The carrier may be a solvent.

The carrier of the nicotine solution may be any suitable solvent such that the nicotine solution can be vaporized for use. In one aspect the solvent is selected from glycerol, propylene glycol, 1,3-propane diol and mixtures thereof. In one aspect the solvent is selected from glycerol, propylene glycol and mixtures thereof. In one aspect the solvent is at least glycerol. In one aspect the solvent consists essentially of glycerol. In one aspect the solvent consists of glycerol.

In one aspect the solvent is at least propylene glycol. In one aspect the solvent consists essentially of propylene glycol. In one aspect the solvent consists of propylene glycol. In one aspect the solvent is at least a mixture of propylene glycol and glycerol. In one aspect the solvent consists essentially of a mixture of propylene glycol and glycerol. In one aspect the solvent consists of a mixture of propylene glycol and glycerol.

The carrier of the nicotine formulation may be present in any suitable amount. In one aspect the carrier is present in an amount of 1 to 98 wt % based on the formulation. In one aspect the carrier is present in an amount of 5 to 98 wt % based on the formulation. In one aspect the carrier is present in an amount of 10 to 98 wt % based on the formulation. In one aspect the carrier is present in an amount of 20 to 98 wt % based on the formulation. In one aspect the carrier is present in an amount of 30 to 98 wt % based on the formulation. In one aspect the carrier is present in an amount of 40 to 98 wt % based on the formulation. In one aspect the carrier is present in an amount of 50 to 98 wt % based on the formulation. In one aspect the carrier is present in an amount of 60 to 98 wt % based on the formulation. In one aspect the carrier is present in an amount of 70 to 98 wt % based on the formulation. In one aspect the carrier is present in an amount of 80 to 98 wt % based on the formulation. In one aspect the carrier is present in an amount of 90 to 98 wt % based on the formulation. In one aspect the carrier is present in an amount of 1 to 90 wt % based on the formulation. In one aspect the carrier is present in an amount of 5 to 90 wt % based on the formulation. In one aspect the carrier is present in an amount of 10 to 90 wt % based on the formulation. In one aspect the carrier is present in an amount of 20 to 90 wt % based on the formulation. In one aspect the carrier is present in an amount of 30 to 90 wt % based on the formulation. In one aspect the carrier is present in an amount of 40 to 90 wt % based on the formulation. In one aspect the carrier is present in an amount of 50 to 90 wt % based on the formulation. In one aspect the carrier is present in an amount of 60 to 90 wt % based on the formulation. In one aspect the carrier is present in an amount of 70 to 90 wt % based on the formulation. In one aspect the carrier is present in an amount of 80 to 90 wt % based on the formulation.

The nicotine solution may also comprise flavoring components. In this case the carrier may preferably be propylene glycol. As used herein, the terms "flavor" and "flavorant" refer to materials which, where local regulations permit, may be used to create a desired taste or aroma in a product for adult consumers. They may include extracts (e.g. liquorice, hydrangea, Japanese white bark magnolia leaf, chamomile, fenugreek, clove, menthol, Japanese mint, aniseed, cinnamon, herb, wintergreen, cherry, berry, peach, apple, mango, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In one aspect the nicotine formulation further comprises water. The water may be present in any suitable amount. In one aspect water is present in an amount of 1 to 50 wt % based on the formulation. In one aspect water is present in an amount of 5 to 50 wt % based on the formulation. In one aspect water is present in an amount of 10 to 50 wt % based on the formulation. In one aspect water is present in an amount of 20 to 50 wt % based on the formulation. In one aspect water is present in an amount of 1 to 40 wt % based on the formulation. In one aspect water is present in an amount of 5 to 40 wt % based on the formulation. In one aspect water is present in an amount of 10 to 40 wt % based on the formulation. In one aspect water is present in an amount of 20 to 40 wt % based on the formulation. In one aspect water is present in an amount of 1 to 30 wt % based on the formulation. In one aspect water is present in an amount of 5 to 30 wt % based on the formulation. In one aspect water is present in an amount of 10 to 30 wt % based on the formulation. In one aspect water is present in an amount of 20 to 30 wt % based on the formulation.

In one aspect the combined amount of carrier and water in the nicotine formulation is from 1 to 98 wt % based on the formulation. In one aspect the combined amount of carrier and water in the nicotine formulation is 5 to 98 wt % based on the formulation. In one aspect the combined amount of carrier and water in the nicotine formulation is 10 to 98 wt % based on the formulation. In one aspect the combined amount of carrier and water in the nicotine formulation is 20 to 98 wt % based on the formulation. In one aspect the combined amount of carrier and water in the nicotine formulation is 30 to 98 wt % based on the formulation. In one aspect the combined amount of carrier and water in the nicotine formulation is 40 to 98 wt % based on the formulation. In one aspect the combined amount of carrier and water in the nicotine formulation is 50 to 98 wt % based on the formulation. In one aspect the combined amount of carrier and water in the nicotine formulation is 60 to 98 wt % based on the formulation. In one aspect the combined amount of carrier and water in the nicotine formulation is 70 to 98 wt % based on the formulation. In one aspect the combined amount of carrier and water in the nicotine formulation is 80 to 98 wt % based on the formulation. In one aspect the combined amount of carrier and water in the nicotine formulation is 90 to 98 wt % based on the formulation. In one aspect the combined amount of carrier and water in the nicotine formulation is 1 to 90 wt % based on the formulation. In one aspect the combined amount of carrier and water in the nicotine formulation is 5 to 90 wt % based on the formulation. In one aspect the combined amount of carrier and water in the nicotine formulation is 10 to 90 wt % based on the formulation. In one aspect the combined amount of carrier and water in the nicotine formulation is 20 to 90 wt % based on the formulation. In one aspect the combined amount of carrier and water in the nicotine formulation is 30 to 90 wt % based on the formulation. In one aspect the combined amount of carrier and water in the nicotine formulation is 40 to 90 wt % based on the formulation. In one aspect the combined amount of carrier and water in the nicotine formulation is 50 to 90 wt % based on the formulation. In one aspect the combined amount of carrier and water in the nicotine formulation is 60 to 90 wt % based on the formulation. In one aspect the combined amount of carrier and water in the nicotine formulation is 70 to 90 wt % based on the formulation. In one aspect the combined amount of carrier and water in the nicotine formulation is 80 to 90 wt % based on the formulation. In one aspect the combined amount of carrier and water in the nicotine formulation is 90 to 90 wt % based on the formulation.

In one aspect the nicotine formulation may contain solvents which advantageously allow for the preparation of the formulation.

Nicotine

In the context of the present disclosure, reference to a nicotine formulation comprising nicotine in free base form i.e. unprotonated form, means that the amount of nicotine in unprotonated form is not minimal. For example, the amount of unprotonated nicotine is typically greater than 1% w/w.

The nicotine formulation comprises nicotine in unprotonated form. In one aspect the nicotine formulation further comprises nicotine in protonated form. In one aspect the nicotine formulation comprises nicotine in unprotonated form and nicotine in monoprotonated form. In one aspect the nicotine formulation comprises nicotine in unprotonated form and nicotine in diprotonated form. In one aspect the nicotine formulation comprises nicotine in unprotonated form, nicotine in monoprotonated form and nicotine in diprotonated form.

In one aspect from 5 to 80 wt % of the nicotine present in the formulation is in protonated form. In one aspect from 5 to 75 wt % of the nicotine present in the formulation is in protonated form. In one aspect from 5 to 70 wt % of the nicotine present in the formulation is in protonated form. In one aspect from 5 to 65 wt % of the nicotine present in the formulation is in protonated form. In one aspect from 5 to 60 wt % of the nicotine present in the formulation is in protonated form. In one aspect from 5 to 55 wt % of the nicotine present in the formulation is in protonated form. In one aspect from 5 to 50 wt % of the nicotine present in the formulation is in protonated form. In one aspect from 5 to 45 wt % of the nicotine present in the formulation is in protonated form. In one aspect from 5 to 40 wt % of the nicotine present in the formulation is in protonated form. In one aspect from 5 to 35 wt % of the nicotine present in the formulation is in protonated form. In one aspect from 5 to 30 wt % of the nicotine present in the formulation is in protonated form. In one aspect from 5 to 25 wt % of the nicotine present in the formulation is in protonated form. In one aspect from 5 to 20 wt % of the nicotine present in the formulation is in protonated form. In one aspect from 5 to 15 wt % of the nicotine present in the formulation is in protonated form. In one aspect from 5 to 10 wt % of the nicotine present in the formulation is in protonated form.

In one aspect from 50 to 95 wt % of the nicotine present in the formulation is in unprotonated form. In one aspect from 55 to 95 wt % of the nicotine present in the formulation is in unprotonated form. In one aspect from 60 to 95 wt % of the nicotine present in the formulation is in unprotonated form. In one aspect from 65 to 95 wt % of the nicotine present in the formulation is in unprotonated form. In one aspect from 70 to 95 wt % of the nicotine present in the formulation is in unprotonated form. In one aspect from 75 to 95 wt % of the nicotine present in the formulation is in unprotonated form. In one aspect from 80 to 95 wt % of the nicotine present in the formulation is in unprotonated form. In one aspect from 85 to 95 wt % of the nicotine present in the formulation is in unprotonated form. In one aspect from 90 to 95 wt % of the nicotine present in the formulation is in unprotonated form.

In one aspect from 50 to 99 wt % of the nicotine present in the formulation is in unprotonated form. In one aspect from 55 to 99 wt % of the nicotine present in the formulation is in unprotonated form. In one aspect from 60 to 99 wt % of the nicotine present in the formulation is in unprotonated form. In one aspect from 65 to 99 wt % of the nicotine present in the formulation is in unprotonated form. In one aspect from 70 to 99 wt % of the nicotine present in the formulation is in unprotonated form. In one aspect from 75 to 99 wt % of the nicotine present in the formulation is in unprotonated form. In one aspect from 80 to 99 wt % of the nicotine present in the formulation is in unprotonated form. In one aspect from 85 to 99 wt % of the nicotine present in the formulation is in unprotonated form. In one aspect from 90 to 99 wt % of the nicotine present in the formulation is in unprotonated form. In one aspect from 95 to 99 wt % of the nicotine present in the formulation is in unprotonated form.

In one aspect at least 50 wt % of the nicotine present in the formulation is in unprotonated form. In one aspect at least 55 wt % of the nicotine present in the formulation is in unprotonated form. In one aspect at least 60 wt % of the nicotine present in the formulation is in unprotonated form. In one aspect at least 65 wt % of the nicotine present in the formulation is in unprotonated form. In one aspect at least 70 wt % of the nicotine present in the formulation is in unprotonated form. In one aspect at least 75 wt % of the nicotine present in the formulation is in unprotonated form. In one aspect at least 80 wt % of the nicotine present in the formulation is in unprotonated form. In one aspect at least 85 wt % of the nicotine present in the formulation is in unprotonated form. In one aspect at least 90 wt % of the nicotine present in the formulation is in unprotonated form. In one aspect at least 95 wt % of the nicotine present in the formulation is in unprotonated form. In one aspect at least 99 wt % of the nicotine present in the formulation is in unprotonated form. In one aspect at least 99.9 wt % of the nicotine present in the formulation is in unprotonated form.

In one aspect the nicotine formulation contains nicotine substantially in free base form—by this is meant at least 99 wt % of the nicotine present in the formulation is in unprotonated form.

The relevant amounts of nicotine which are present in the formulation in protonated form are specified herein. These amounts may be readily calculated by one skilled in the art. Nicotine, 3-(1-methylpyrrolidin-2-yl) pyridine, is a diprotic base with pKa of 3.12 for the pyridine ring and 8.02 for the pyrrolidine ring. It can exist in pH-dependent protonated (mono- and di-) and non-protonated (free base) forms which have different bioavailability.

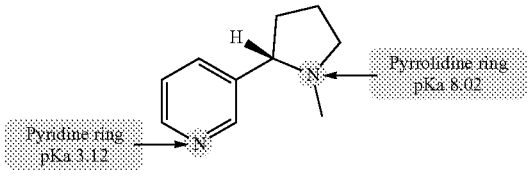

The distribution of protonated and non-protonated nicotine will vary at various pH increments.

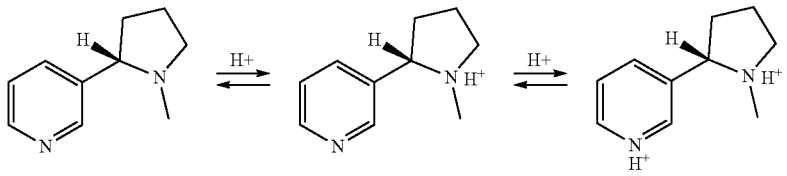

The fraction of non-protonated nicotine will be predominant at high pH levels whilst a decrease in the pH will see an increase of the fraction of protonated nicotine (mono- or di-depending on the pH). If the relative fraction of protonated nicotine and the total amount of nicotine in the sample are known, the absolute amount of protonated nicotine can be calculated.

The relative fraction of protonated nicotine in formulation can be calculated by using the Henderson-Hasselbalch equation, which describes the pH as a derivation of the acid dissociation constant equation, and it is extensively employed in chemical and biological systems. Consider the following equilibrium:

$$B + H^+ \rightleftarrows BH^+$$

For this equilibrium the Henderson-Hasselbalch may be expressed as:

$$\mathrm{pH} = pKa + \log\frac{[B]}{[BH+]}$$

Where [B] is the amount of non-protonated nicotine (i.e. free base), [BH+] the amount of protonated nicotine (i.e. conjugate acid) and pKa is the reference pKa value for the pyrrolidine ring nitrogen of nicotine (For the pyrrolidine moiety of nicotine in water the pKa=8.01 at 25° C. quoted in reference: Duell A K, Pankow J F, Peyton D H Free-Base Nicotine Determination in Electronic Cigarette Liquids by 1H NMR Spectroscopy. Chem Res Toxicol. 2018 Jun. 18; 31(6):431-434. doi: 10.1021/acs.chemrestox.8b00097). The relative fraction of protonated nicotine can be derived from the alpha value of the non-protonated nicotine calculated from the Henderson-Hasselbalch equation as:

$$\%\ \text{protonated nicotine} = 100 - \left\{\frac{\frac{[B]}{[BH+]}}{\left\{1 + \frac{[B]}{[BH+]}\right\}} * 100\right\}$$

Determination of the two pKa values for nicotine at different temperatures may be also carried as described by Peter M Clayton, Carl A. Vas, Tam T T Bui, Alex F. Drake and Kevin McAdam in *Analytical Methods,* 5 81-88 (2013)—'*Spectroscopic investigations into the acid-base properties of nicotine at different temperatures*'.

Nicotine formulations may be provided having desirable properties of flavor, impact, irritation, smoothness and/or nicotine reward for the user both when the nicotine content is relatively low, such as 1.9 wt % or 1.8 wt % nicotine or less and when the nicotine content is relatively high, such as greater than 1.9 wt % or 1.8 wt % nicotine. Thus in one aspect the nicotine formulation comprises nicotine in an amount of no greater than 1.9 wt % or 1.8 wt % based on the total weight of the formulation. Thus in one aspect the nicotine formulation comprises nicotine in an amount of greater than 1.9 wt % or 1.8 wt % based on the total weight of the formulation.

The relative fraction of protonated nicotine in formulation can also be determined in accordance with Duell et al., Chem Res Toxicol. 2018 Jun. 18; 31(6): 431-434.

Nicotine may be provided at any suitable amount depending on the desired dosage when inhaled by the user. In one aspect nicotine is present in an amount of no greater than 6 wt % based on the total weight of the formulation. In one aspect nicotine is present in an amount of from 0.4 to 6 wt % based on the total weight of the formulation. In one aspect nicotine is present in an amount of from 0.8 to 6 wt % based on the total weight of the formulation. In one aspect nicotine is present in an amount of from 1 to 6 wt % based on the total weight of the formulation. In one aspect nicotine is present in an amount of from 1.8 to 6 wt % based on the total weight of the formulation. In one aspect nicotine is present in an amount of from 0.4 to 5 wt % based on the total weight of the formulation. In one aspect nicotine is present in an amount of from 0.8 to 5 wt % based on the total weight of the formulation. In one aspect nicotine is present in an amount of from 1 to 5 wt % based on the total weight of the formulation. In one aspect nicotine is present in an amount of from 1.8 to 5 wt % based on the total weight of the formulation. In one aspect nicotine is present in an amount of no greater than 4 wt % based on the total weight of the formulation. In one aspect nicotine is present in an amount of from 0.4 to 4 wt % based on the total weight of the formulation. In one aspect nicotine is present in an amount of from 0.8 to 4 wt % based on the total weight of the formulation. In one aspect nicotine is present in an amount of from 1 to 4 wt % based on the total weight of the formulation. In one aspect nicotine is present in an amount of from 1.8 to 4 wt % based on the total weight of the formulation. In one aspect nicotine is present in an amount of no greater than 3 wt % based on the total weight of the formulation. In one aspect nicotine is present in an amount of from 0.4 to 3 wt % based on the total weight of the formulation. In one aspect nicotine is present in an amount of from 0.8 to 3 wt % based on the total weight of the formulation. In one aspect nicotine is present in an amount of from 1 to 3 wt % based on the total weight of the formulation. In one aspect nicotine is present in an amount of from 1.8 to 3 wt % based on the total weight of the formulation. In one aspect nicotine is present in an amount of no greater than 1.9 wt % based on the total weight of the formulation. In one aspect nicotine is present in an amount of no greater than 1.8 wt % based on the total weight of the formulation. In one aspect nicotine is present in an amount of from 0.4 to 1.9 wt % based on the total weight of the formulation. In one aspect nicotine is present in an amount of from 0.4 to 1.8 wt % based on the total weight of the formulation. In one aspect nicotine is present in an amount of from 0.5 to 1.9 wt % based on the total weight of the formulation. In one aspect nicotine is present in an amount of from 0.5 to 1.8 wt % based on the total weight of the formulation In one aspect nicotine is present in an amount of from 0.8 to 1.9 wt % based on the total weight of the formulation. In one aspect nicotine is present in an amount of from 0.8 to 1.8 wt % based on the total weight of the formulation. In one aspect nicotine is present in an amount of from 1 to 1.9 wt % based on the total weight of the formulation. In one aspect nicotine is present in an amount of from 1 to 1.8 wt % based on the total weight of the formulation. In one aspect nicotine is present in an amount of less than 1.9 wt % based on the total weight of the formulation. In one aspect nicotine is present in an amount of less than 1.8 wt % based on the total weight of the formulation. In one aspect nicotine is present in an amount of from 0.4 to less than 1.9 wt % based on the total weight of the formulation. In one aspect nicotine is present in an amount of from 0.4 to less than 1.8 wt % based on the total weight of the formulation. In one aspect nicotine is present in an amount of from 0.5 to less than 1.9 wt % based on the total weight of the formulation. In one aspect nicotine is present in an amount of from 0.5 to less than 1.8 wt % based on the total weight of the formulation. In one aspect nicotine is present in an amount of from 0.8 to less than 1.9 wt % based on the total weight of the formulation. In one aspect nicotine is present in an amount of from 0.8 to less than 1.8 wt % based on the total weight of the formulation. In one aspect nicotine is present in an amount of from 1 to less than 1.9 wt % based on the total weight of the formulation. In one aspect nicotine is present in an amount of from 1 to less than 1.8 wt % based on the total weight of the formulation.

Carbon Dioxide Source

As discussed herein the present disclosure provides a carbon dioxide source capable of providing carbon dioxide in situ. The carbon dioxide may envelope the aerosol droplets. The nicotine formulation is vaporized or aerosolized and before, during or after this vaporization or aerosolization, carbon dioxide is provided from the carbon dioxide source. The carbon dioxide is then contacted with the vaporized or aerosolized nicotine formulation to thereby protonate nicotine free base and generate an aerosol comprising an increased amount of protonated nicotine. It will be appreciated by one skilled in the art that the steps of (iii) vaporizing the nicotine formulation; and (iv) providing carbon dioxide from the carbon dioxide source, may be performed in any order, may be performed simultaneously or a combination of both. For example one of step (iii) or (iv) may be initiated and then subsequently the second of step (iii) or (iv) may be initiated, such that the steps are both sequential and then simultaneous.

The carbon dioxide source may be any suitable source and may be provided in any suitable form. In one aspect the nicotine formulation contains the carbon dioxide source. In other words, a single formulation may be provided containing not only the nicotine but also the carbon dioxide source. In another aspect, the nicotine formulation is distinct from the carbon dioxide source. In other words, the nicotine formulation and carbon dioxide source are provided separately and the nicotine and carbon dioxide are only contacted after respective steps (iii) and (iv).

As will be appreciated by one skilled in the art there are multiple ways in which carbon dioxide may be provided. For example, carbon dioxide may be provided from the carbon dioxide source by electrolytical production, chemical production, thermal production or a combination thereof. In one aspect, the carbon dioxide source may be carbon dioxide in solid, liquid or gas form such as carbon dioxide in liquid or gas form.

Electrolytical Production—carbon dioxide is produced through the passage of an electric current through an electrolyte such as aqueous electrolyte solution. For example, in the presence of acetic acid electrolytically derived $CO_2$ may be produced. (This may be the Kolbe electrolysis reaction from which ethane may also arise). Other carboxylic acids may also undergo similar electrolytic reaction, such as a mixture of acetic acid and an acetic salt. The presence of a neutral salt electrolyte such as sodium chloride or potassium chloride may also be desirable, and may increase the conductivity of electrolyte solution. Electrolytical production of $CO_2$ is highly controllable. It will be appreciated by one skilled in the art that for the production to occur passage of an electrical current through the electrolyte thereby resulting in electrolysis and the generation of carbon dioxide is required. The process may be controlled by both the applied electrical current and the concentration of electrolyte present in the electrolyte solution. The electrodes required for the electrolysis are ideally composed of an inert conductor material which does not undergo (galvanic) corrosion.

Chemical Production—carbon dioxide is produced through by the chemical decomposition of a suitable material such as a carbonate or hydrogen carbonate salt by the action of acid (such as acetic acid or hydrochloric acid). The use of sodium hydrogen carbonate together with (dilute) hydrochloric acid is particularly advantageous because the products of the reaction are benign.

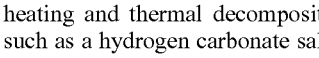

$$NaHCO_3+HCl=NaCl+H_2O+CO_2$$

The process is controllable by the incremental addition of reactant(s).

Thermal Production—carbon dioxide is produced by the heating and thermal decomposition of a suitable material such as a hydrogen carbonate salt. The heating and thermal decomposition may be achieved by use of a coil heater similar to that used in aerosol production or an ancillary heater. Depending on the material, the decomposition is typically initiated at temperatures above 80° C.

Depending on the source of carbon dioxide, a suitable nicotine delivery system may be provided. Suitable nicotine delivery systems are described further herein.

As discussed herein, in one aspect the present disclosure provides a nicotine delivery system comprising (i) a nicotine formulation comprising nicotine; and (ii) a carbon dioxide precursor capable of forming carbon dioxide, wherein the carbon dioxide precursor is an electrolyte.

In one aspect, the electrolyte is an electrolyte solution of one more compounds selected from carbonic acid and salts thereof, organic acids and salts thereof, and mixtures thereof. In one aspect, the electrolyte is an electrolyte solution of one more compounds selected from carbonate salts, hydrogen carbonate salts, organic acids and mixtures thereof. In one aspect, the electrolyte is an electrolyte solution of an organic acid. In one aspect the organic acid is at least acetic acid. Acetic acid or a similar organic acid may be augmented by the presence of neutral salt electrolytes such as sodium chloride or potassium chloride or mixtures thereof. The presence of salts will increase the conductivity of the electrolyte solution which includes acetic acid or similar organic acid The organic acid may be present in any suitable amount to provide the carbon dioxide from the electrolyte on electrolysis. In one aspect, organic acid is present in an amount of from 0.1 to 10 wt % based on the electrolyte solution. In one aspect, organic acid is present in an amount of from 0.1 to 9 wt % based on the electrolyte solution. In one aspect, organic acid is present in an amount of from 0.1 to 8 wt % based on the electrolyte solution. In one aspect, organic acid is present in an amount of from 0.1 to 7 wt % based on the electrolyte solution. In one aspect, organic acid is present in an amount of from 0.1 to 6 wt % based on the electrolyte solution. In one aspect, organic acid is present in an amount of from 0.1 to 5 wt % based on the electrolyte solution. In one aspect, organic acid is present in an amount of from 0.1 to 4 wt % based on the electrolyte solution. In one aspect, organic acid is present in an amount of from 0.1 to 3 wt % based on the electrolyte solution. In one aspect, organic acid is present in an amount of from 0.1 to 2 wt % based on the electrolyte solution. In one aspect, organic acid is present in an amount of from 0.1 to 1 wt % based on the electrolyte solution.

In one aspect, organic acid is present in an amount of from 0.2 to 10 wt % based on the electrolyte solution. In one aspect, organic acid is present in an amount of from 0.5 to 10 wt % based on the electrolyte solution. In one aspect, organic acid is present in an amount of from 1 to 10 wt % based on the electrolyte solution. In one aspect, organic acid is present in an amount of from 1 to 9 wt % based on the electrolyte solution. In one aspect, organic acid is present in an amount of from 1 to 8 wt % based on the electrolyte solution. In one aspect, organic acid is present in an amount of from 1 to 7 wt % based on the electrolyte solution. In one aspect, organic acid is present in an amount of from 1 to 6 wt % based on the electrolyte solution. In one aspect, organic acid is present in an amount of from 1 to 5 wt % based on the electrolyte solution.

As discussed herein in one aspect the organic acid is at least acetic acid. In one aspect, acetic acid is present in an amount of from 0.1 to 10 wt % based on the electrolyte solution. In one aspect, acetic acid is present in an amount of from 0.1 to 9 wt % based on the electrolyte solution. In one aspect, acetic acid is present in an amount of from 0.1 to 8 wt % based on the electrolyte solution. In one aspect, acetic acid is present in an amount of from 0.1 to 7 wt % based on the electrolyte solution. In one aspect, acetic acid is present in an amount of from 0.1 to 6 wt % based on the electrolyte solution. In one aspect, acetic acid is present in an amount of from 0.1 to 5 wt % based on the electrolyte solution. In one aspect, acetic acid is present in an amount of from 0.1 to 4 wt % based on the electrolyte solution. In one aspect, acetic acid is present in an amount of from 0.1 to 3 wt % based on the electrolyte solution. In one aspect, acetic acid is present in an amount of from 0.1 to 2 wt % based on the electrolyte solution. In one aspect, acetic acid is present in an amount of from 0.1 to 1 wt % based on the electrolyte solution.

In one aspect, acetic acid is present in an amount of from 0.2 to 10 wt % based on the electrolyte solution. In one aspect, acetic acid is present in an amount of from 0.5 to 10 wt % based on the electrolyte solution. In one aspect, acetic acid is present in an amount of from 1 to 10 wt % based on the electrolyte solution. In one aspect, acetic acid is present in an amount of from 1 to 9 wt % based on the electrolyte solution. In one aspect, acetic acid is present in an amount of from 1 to 8 wt % based on the electrolyte solution. In one aspect, acetic acid is present in an amount of from 1 to 7 wt % based on the electrolyte solution. In one aspect, acetic acid is present in an amount of from 1 to 6 wt % based on the electrolyte solution. In one aspect, acetic acid is present in an amount of from 1 to 5 wt % based on the electrolyte solution.

In one aspect, the electrolyte further comprises a flavor compound. In one aspect, the electrolyte comprises a salt. In one aspect, the electrolyte comprises a neutral salt electrolyte. The salt may be selected from sodium chloride, potassium chloride, and mixtures thereof. These salts act to increase the conductivity of the electrolyte solution.

As discussed herein, in one aspect the present disclosure provides a nicotine delivery system comprising (i) a nicotine formulation comprising nicotine; and (ii) a carbon dioxide precursor capable of forming carbon dioxide; wherein the carbon dioxide precursor is a couple of (a) one or more carbonate salts, one or more hydrogen carbonate salts, or ammonium carbonate, or ammonium hydrogen carbonate or a mixture thereof; and (b) one or more acids.

In one aspect, the couple is (a) one or more hydrogen carbonate salts and (b) one or more organic acids. In one aspect, the one or more hydrogen carbonate salts is selected from sodium bicarbonate, potassium bicarbonate, ammonium bicarbonate and mixtures thereof. In one aspect, the one or more hydrogen carbonate salts is sodium bicarbonate. In one aspect, the one or more hydrogen carbonate salts is potassium bicarbonate. In one aspect, the one or more acids is selected from acetic acid, citric acid, tartaric acid, fumaric acid, succinic acid, adipic acid, malic acid, maleic acid, oxalic acid, glutaric acid, malonic acid, hydrochloric acid, lactic acid, pyruvic acid, levulinic acid and mixtures thereof.

As discussed herein, in one aspect the present disclosure provides a nicotine delivery system comprising (i) a nicotine formulation comprising nicotine; and (ii) a carbon dioxide precursor capable of forming carbon dioxide; wherein the carbon dioxide precursor is selected from a carbonate, hydrogen carbonate or mixture thereof that thermally degrades to form carbon dioxide.

In one aspect, the carbon dioxide precursor is selected from the group consisting of metallic salts, ammonium carbonate salts and mixtures thereof. In one aspect, the carbon dioxide precursor is selected from the group consisting of sodium carbonate, sodium hydrogen carbonate, ammonium carbonate, ammonium hydrogen carbonate, calcium carbonate, calcium hydrogen carbonate, copper carbonate, and mixtures thereof.

As discussed herein, in one aspect the present disclosure provides a nicotine delivery system comprising (i) a nicotine formulation comprising nicotine; and (ii) a carbon dioxide source that comprises carbon dioxide in solid, liquid or gas form such as carbon dioxide in the liquid or gas phase.

In one aspect, the carbon dioxide source comprises carbon dioxide in the gas phase.

In one aspect of the present disclosure provides a nicotine delivery system comprising (i) a nicotine formulation comprising nicotine; and (ii) a carbon dioxide source that comprises carbon dioxide at a pressure of greater than 1 atmosphere (101.325 kPa). As will be appreciated by one skilled in the art, carbon dioxide may be provided in a compressed form at a pressure of greater than 1 atmosphere (101.325 kPa).

We have found that when carbon dioxide is provided in a compressed form at a pressure of greater than 1 atmosphere (101.325 kPa), when it is released from the container in which it is contained it expands to atmospheric pressure. This expansion results in the cooling of the carbon dioxide; this is known as adiabatic cooling. The cool carbon dioxide may then be combined with the vaporized or aerosolized nicotine formulation. Since the nicotine formulation is typically vaporized or aerosolized by heating then it may be at a temperature which is higher than is desirable for inhalation by the user. The combining of the cool carbon dioxide and the undesirably warm vapor/aerosol, allows for the cooling of the vapor/aerosol to a more desirable temperature. The degree or extent of cooling may be selected to provide the desired cooling effect. For example, cooling may be provided to a temperature below body temperature or to a temperature below ambient temperature such that a cooling sensation experience is provided. Thus the carbon dioxide may not only protonate the nicotine present in the vapor/aerosol but provide a further advantage of cooling the vapor/aerosol.

It is noted that this system may also be used in certain next generation products. A number of products produce hot vapor by heating (but not burning) tobacco. These hot vapors may have to be cooled before inhalation. The use of carbon dioxide as described herein makes use of the adiabatic expansion of the carbon dioxide gas to cool the aerosol before leaving a device for inhalation. The hot gas of a tobacco heating product can be combined with the cooler carbon dioxide gas obtained from expanded carbon dioxide and provides an advantageous way of cooling the aerosol. Thus, the present disclosure further provides a method of generating an aerosol comprising protonated nicotine, the method comprising the steps of: (i) providing tobacco; (ii) providing a carbon dioxide source that comprises carbon dioxide at a pressure of greater than 1 atmosphere (101.325 kPa); (iii) heating the tobacco or passing an aerosol over the tobacco, to form a vapor or aerosol containing nicotine; (iv) providing carbon dioxide from the carbon dioxide source, and (v) contacting the carbon dioxide with the vapor or aerosol containing nicotine to thereby protonate nicotine free base and generate a vapor or aerosol comprising protonated nicotine.

In one aspect of the present disclosure the carbon dioxide source is carbon dioxide at a pressure of greater than 1 atmosphere (101.325 kPa) wherein the carbon dioxide contains a flavor. When the carbon dioxide is released from the container in which it is contained, it expands and is combined with mixed with the vaporized or aerosolized nicotine formulation. This vapor/aerosol will most likely be formed by heating. By delivering the flavor in a vapor form in the carbon dioxide, rather than in the aerosol precursor, at least three advantages are observed. Firstly, the flavor will be preferentially in the vapor phase, rather than being trapped in aerosol particles—this will improve the flavor perception by the user. Secondly, when flavor is delivered in the aerosol precursor (nicotine formulation) i.e. the e-liquid which is heated, it may be necessary to use propylene glycol to solubilize the flavor. Propylene glycol is harsh to inhale and is therefore its use is to be minimized or to be avoided. The provision of the flavor in the carbon dioxide allows for the reduction or even complete avoidance of this harsh component. Thus the aerosol precursor may be formed from a mixture of glycerol and water; a formulation which would be otherwise unfavorable for the solvation of many flavors. Thirdly, when flavor s are included in the vaporizable or aerosolizable formulation, they may undergo pyrolysis during the heating required to form the vapor/aerosol, creating unfavorable compounds. The production of unwanted by-products may be reduced if the vaporizable or aerosolizable formulation contains no flavor or a reduced amount of flavor. In this aspect, it is not a requirement that nicotine be present in the vaporized or aerosolized formulation. Thus, the present disclosure provides a method of generating an aerosol, the method comprising the steps of:

(i) providing a vaporizable or aerosolizable formulation;

(ii) providing a carbon dioxide source that comprises carbon dioxide at a pressure of greater than 1 atmosphere (101.325 kPa), wherein the carbon dioxide contains a flavor;

(iii) vaporizing or aerosolizing the formulation;

(iv) providing carbon dioxide in the gas phase from the carbon dioxide source, and (v) contacting the carbon dioxide with the vaporized or aerosolized formulation.

a nicotine delivery system comprising (i) a vaporizable or aerosolizable formulation; and (ii) a carbon dioxide source that comprises carbon dioxide at a pressure of greater than 1 atmosphere (101.325 kPa), wherein the carbon dioxide contains a flavor.

In one aspect of the present disclosure the carbon dioxide source comprises carbon dioxide at a pressure of greater than 1 atmosphere (101.325 kPa) wherein the carbon dioxide contains nicotine. When the carbon dioxide is released from the container in which it is contained, it expands and is combined with the vaporized or aerosolized formulation. This vapor/aerosol will most likely be formed by heating. By delivering the nicotine in a vapor form in the carbon dioxide, rather than in the aerosol precursor, at least three advantages are observed. Firstly, the nicotine will be preferentially in the vapor phase, rather than being trapped in aerosol particles—this will improve the inhalation of the nicotine into the lungs of the user. Secondly, the carbon dioxide acts as an acid and protonates the nicotine before it is entrapped in the aerosol stream. Thirdly, when nicotine is included in the vaporizable or aerosolizable formulation, it may undergo pyrolysis during the heating required to form the vapor/aerosol. The production of unwanted by-products is reduced if the vaporizable or aerosolizable formulation contains no nicotine or a reduced amount of nicotine. In these aspects, it is not a requirement that nicotine be present in the vaporized or aerosolized formulation. Thus, the present disclosure provides a method of generating an aerosol, the method comprising the steps of:

(i) providing a vaporizable or aerosolizable formulation;

(ii) providing a carbon dioxide source that comprises carbon dioxide at a pressure of greater than 1 atmosphere (101.325 kPa), wherein the carbon dioxide contains nicotine;

(iii) vaporizing or aerosolizing the formulation;

(iv) providing carbon dioxide in the gas phase from the carbon dioxide source, and (v) contacting the carbon dioxide with the vaporized or aerosolized formulation.

In one aspect the carbon dioxide contains nicotine and one or more flavor s.

a nicotine delivery system comprising (i) a vaporizable or aerosolizable formulation; and (ii) a carbon dioxide source that comprises carbon dioxide at a pressure of greater than 1 atmosphere (101.325 kPa), wherein the carbon dioxide contains nicotine. In one aspect the carbon dioxide contains nicotine and one or more flavor s.

In each aspect in which the carbon dioxide source is carbon dioxide at a pressure of greater than 1 atmosphere (101.325 kPa), the carbon dioxide source may contain carbon dioxide in the liquid phase. One skilled in the art would readily appreciate how to provide and store carbon dioxide at a pressure of greater than 1 atmosphere (101.325 kPa). One skilled in the art would readily appreciate how to provide and store carbon dioxide in the liquid phase at a pressure of greater than 1 atmosphere (101.325 kPa). When the carbon dioxide is provided in the liquid phase it will be understood that when it is released from its container and expands it enters the gas phase.

In one aspect the carbon dioxide source is carbon dioxide at a pressure of greater than 110 kPa. In one aspect the carbon dioxide source is carbon dioxide at a pressure of greater than 200 kPa. In one aspect the carbon dioxide source is carbon dioxide at a pressure of greater than 300 kPa. In one aspect the carbon dioxide source is carbon dioxide at a pressure of greater than 400 kPa. In one aspect the carbon dioxide source is carbon dioxide at a pressure of greater than 500 kPa. In one aspect the carbon dioxide source is carbon dioxide at a pressure of greater than 520 kPa. In one aspect the carbon dioxide source is carbon dioxide at a pressure of greater than 600 kPa. In one aspect the carbon dioxide source is carbon dioxide at a pressure of greater than 700 kPa. In one aspect the carbon dioxide source is carbon dioxide at a pressure of greater than 800 kPa. In one aspect the carbon dioxide source is carbon dioxide at a pressure of greater than 900 kPa.

In one aspect there is provided a nicotine delivery system comprising (i) a formulation; and (ii) a carbon dioxide source that comprises carbon dioxide in the solid, liquid or gas phase;

wherein the formulation, the carbon dioxide or both, contain nicotine.

In one aspect there is provided a nicotine delivery system comprising (i) a formulation; and (ii) a carbon dioxide source that comprises carbon dioxide in the liquid or gas phase;

wherein the formulation, the carbon dioxide or both, contain nicotine.

In one aspect there is provided a nicotine delivery system comprising (i) a formulation; and (ii) a container of compressed carbon dioxide;

wherein the formulation, the carbon dioxide or both, contain nicotine.

In one aspect there is provided an electronic vapor provision system comprising (a) a nicotine delivery system comprising (i) a formulation; and (ii) a carbon dioxide source that comprises carbon dioxide in the solid, liquid or gas phase; (b) a vaporize r for vaporizing the formulation for inhalation by a user of the electronic vapor provision system; a power supply comprising a cell or battery for supplying power to the vaporize r; wherein the formulation, the carbon dioxide or both, contain nicotine.

In one aspect there is provided an electronic vapor provision system comprising (a) a nicotine delivery system comprising (i) a formulation; and (ii) a carbon dioxide source that comprises carbon dioxide in the liquid or gas phase; (b) a vaporize r for vaporizing the formulation for inhalation by a user of the electronic vapor provision system; a power supply comprising a cell or battery for supplying power to the vaporize r; wherein the formulation, the carbon dioxide or both, contain nicotine.

In one aspect there is provided an electronic vapor provision system comprising (a) a nicotine delivery system comprising (i) a formulation; and (ii) a container of compressed carbon dioxide; (b) a vaporize r for vaporizing the formulation for inhalation by a user of the electronic vapor provision system; a power supply comprising a cell or battery for supplying power to the vaporize r; wherein the formulation, the carbon dioxide or both, contain nicotine.

As will be appreciated by one skilled in the art, when the nicotine formulation is distinct from the carbon dioxide source, the present disclosure provides delivery via a device having a modular design. In the modular device, one chamber may be provided which is heated to produce a nicotine containing aerosol. A further chamber is provided which provides the carbon dioxide from the carbon dioxide source. For example, in the aspect that the carbon dioxide is provided in solid, liquid or gas form, the further chamber may be an unheated compartment containing carbon dioxide solid, liquid or gas. For example, in the aspect that the carbon dioxide is provided in liquid or gas form, the further chamber may be an unheated compartment containing carbon dioxide liquid or gas. For example, in the aspect that the carbon dioxide is provided in chemical means, the further chamber may be an (unheated) compartment in which the chemical reaction is performed to provide the carbon dioxide. For example, in the aspect that the carbon dioxide is provided in electrical means, the further chamber may be an (unheated) compartment in which the electrolysis is performed by passage of electrical current or charge through an electrolytic cell to generate carbon dioxide (possibly together with hydrogen and oxygen gas).

The formulation may be contained or delivered by any means. In one aspect the present disclosure provides a contained nicotine formulation comprising (a) one or more containers; and (b) a nicotine delivery system as defined herein. The container may be any suitable container, for example to allow for the storage or delivery of the formulation. In one aspect the container is configured for engagement with an electronic vapor provision system. The container may be configured to become fluidly in communication with an electronic vapor provision system so that formulation may be delivered to the electronic vapor provision system. As described above, the present disclosure relates to container which may be used in an electronic vapor provision system, such as an e-cigarette. Throughout the following description the term "e-cigarette" is used; however, this term may be used interchangeably with electronic vapor provision system.

As discussed herein, the container of the present disclosure is typically provided for the delivery of nicotine formulation to or within an e-cigarette. The nicotine formulation may be held within an e-cigarette or may be sold as a separate container for subsequent use with or in an e-cigarette. As understood by one skilled in the art, e-cigarettes may contain a unit known as a detachable cartomizer which typically comprises a reservoir of nicotine formulation, a wick material and a heating element for vaporizing the nicotine. In some e-cigarettes, the cartomizer is part of a single-piece device and is not detachable. In one aspect the container is a cartomizer or is part of a cartomizer. In one aspect the container is not a cartomizer or part of a cartomizer and is a container, such as a tank, which may be used to deliver nicotine formulation to or within an e-cigarette. In one aspect heating is inductive.

In one aspect the container is part of an e-cigarette. Therefore in a further aspect the present disclosure provides an electronic vapor provision system comprising: a nicotine delivery system as defined herein; a vaporize r for vaporizing the nicotine formulation for inhalation by a user of the electronic vapor provision system; a power supply comprising a cell or battery for supplying power to the vaporize r.

In addition to the solution of the present disclosure and to systems such as containers and electronic vapor provision systems containing the same, the present disclosure provides for improving the sensory properties of a vaporized nicotine formulation and/or for reducing the amount of gas phase nicotine produced in an aerosol by a vaporized nicotine formulation. Therefore in a further aspect the present disclosure provides use of carbon dioxide for improving sensory properties of a vaporized nicotine formulation. In a further aspect the present disclosure provides use of carbon dioxide for reducing the amount of gas phase nicotine produced in an aerosol by a vaporized nicotine formulation.

Reference to an improvement in the sensory properties of a vaporized nicotine solution refer may include an improvement in the smoothness of the vaporized nicotine solution as perceived by a user.

The process of the present disclosure may comprises additional steps either before the steps listed, after the steps listed or between one or more of the steps listed.

The invention will now be described with reference to the following non-limiting example.

EXAMPLES

Example 1

Method Used to Estimate Percentage Protonation of Nicotine in Emitted Aerosol

Device Description

The device used was of outline fabrication as shown in FIG. 1 with an aerosol generation unit whereby a nicotine containing aerosol was formed thermally.

Following the formation, the aerosol was mixed with a stream of carbon dioxide gas which was formed electrolytically in a separate unheated chamber. The electrolytic chamber contained 90 g/L aqueous sodium chloride which was augmented with glacial acetic acid added at a number of levels as described in Table 1. Two different device configurations were used: with the gas permeable barrier in place and with its removal. Results are summarized below in Table 2.

TABLE 1

Addition of glacial acetic acid to 90 g/L aq. sodium chloride used in the solution present in the electrolysis chamber

| | Glacial acetic acid added to aqueous sodium chloride |
|---|---|
| A | No addition |
| B | 0.25% w/w |
| C | 0.5% w/w |
| D | 1% w/w |

Aerosol generation and collection: Aerosol generation was complete on a single port instrument. Aerosol particulate matter was collected onto a 47 mm quartz QMA pad (Whatman catalogue number 1851-047) following puffing at 80 mL (puff volume), 3 s (puff interval), 30 s (puff duration), 20 puffs. The E-liquids present in the E-liquid reservoir contained 48.9 Glycerol, 32 propylene glycol, 18 water, 1.065 nicotine [12 mg/mL] % w/w. No flavorings were included.

Quartz Pad treatment and analysis: Following puffing, the quartz pad was placed in a 50 mL centrifuge tube to which was added 7.5 mL toluene and 1.5 mL deionized water (18.2 Mohm·cm) and then place on a roller mixer for 30 minutes (60 rpm). Following a 2004 was taken from the upper organic layer which diluted in 800 μL of toluene. This solution was analyzed for nicotine concentration using GC methodology. In this analysis the amount of unprotonated (free-base) nicotine predominated. To the remainder of the fluid liquid in the centrifuge tube was added 100 μL of 50% aqueous NaOH which mobilizes unprotonated nicotine to form unprotonated nicotine which migrates to the organic layer. A portion is again taken from the organic layer, diluted and analyzed by GC to determine the concentration of total nicotine. From the two measures of nicotine it is possible to calculate an estimation of the percentage protonation of the nicotine emitted from the device.

In outline terms, the analytical method used to assess the level of nicotine protonation in captured aerosol was based as described by El-Hellani et alia in Chem Res Toxicol. 2015; 28: 1532-1537

Results:

TABLE 2

| Solution in electrolytic chamber (Table 1) | Estimated percentage nicotine protonation (no barrier) | Estimated percentage nicotine protonation (with barrier) |
|---|---|---|
| A | 15 | 14 |
| B | 23 | 20 |
| C | 76 | 33 |
| D | 100 | 100 |

Example 2—Propensity of Carbon Dioxide to Acidify Bulk E-Liquid

Initial E-Liquid Measurements

A simplified E-liquid was prepared consisting of S-nicotine added to propylene glycol, the concentration of nicotine in solution was 4 mg/mL.

To determine the pH the E-liquid was diluted in water –1 mL was added to 5 mL of deionized water. A pH electrode meter was calibrated using aqueous buffers at pH 4, 7, and 10. The pH of the E-liquid was determined for two replicates as 9.40 (23.2° C.) and pH9.39 (23.2° C.). The mean pH was 9.395.

Figure 3:
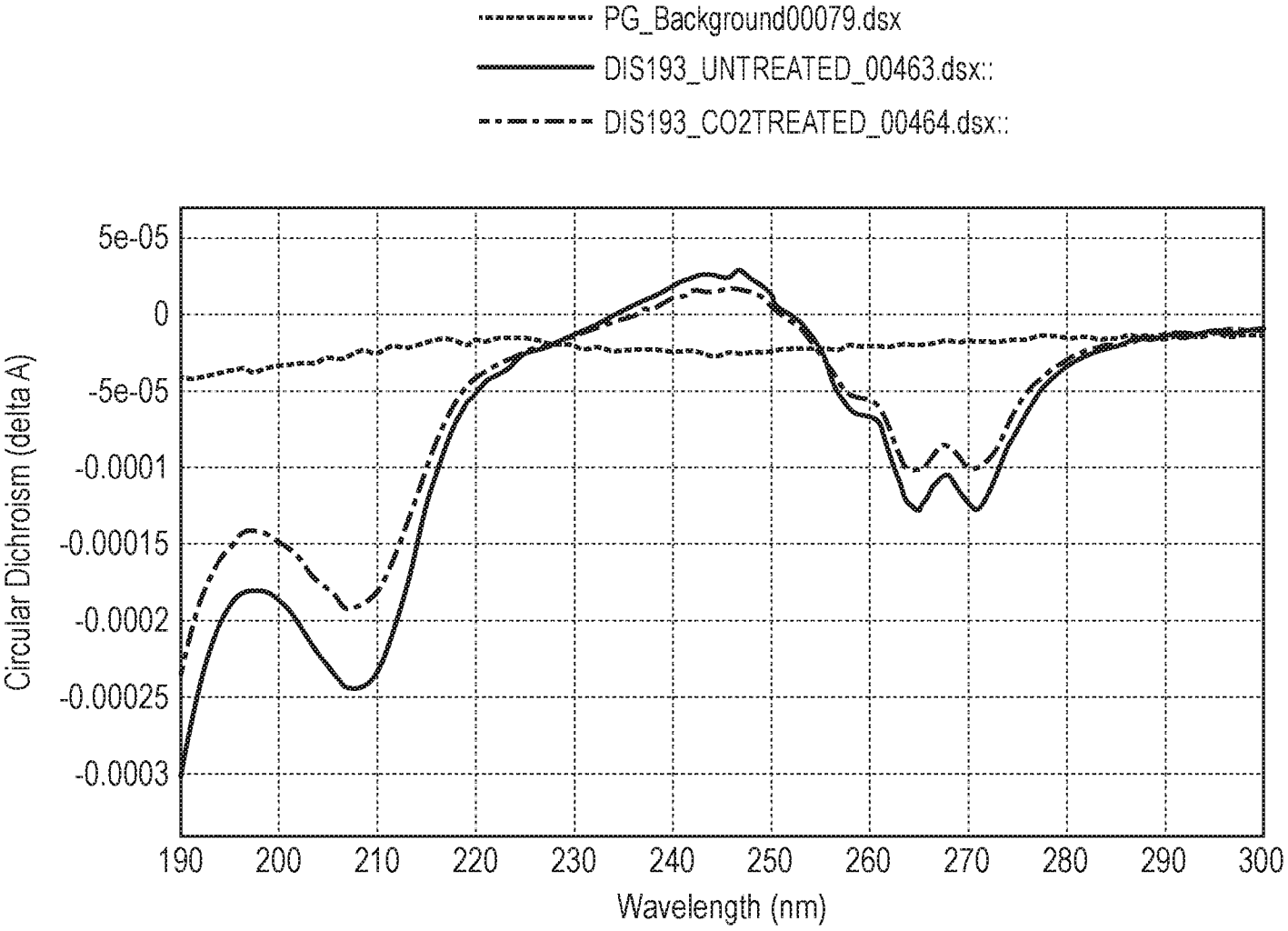
FIG. 3 is a graph showing the change in CD spectrum of 4 mg/mL solution of S-nicotine brought about by the treatment of carbon dioxide, according to certain embodiments of the present disclosure.
Figure 4:
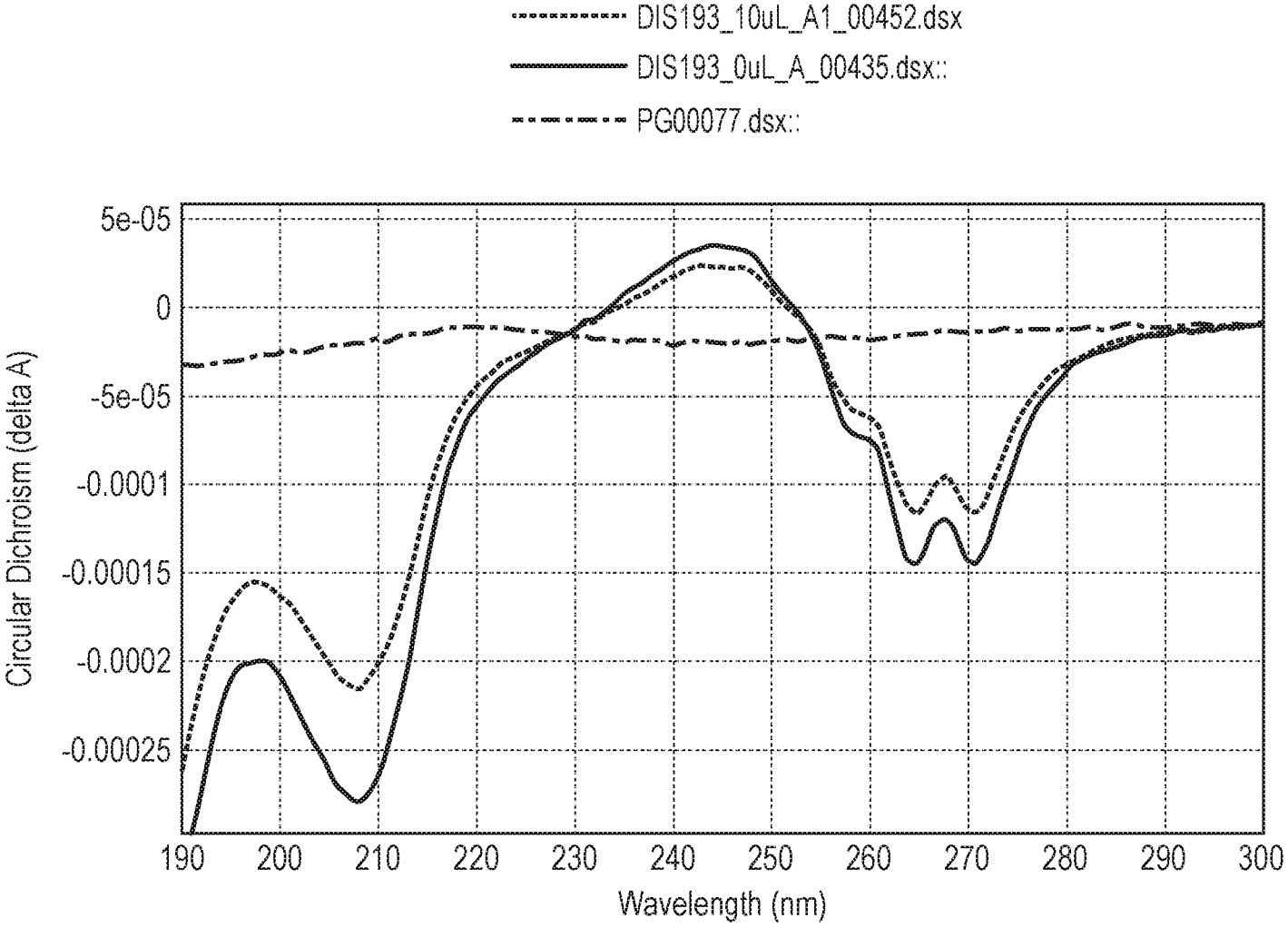
FIG. 4 is a graph showing the change in CD spectrum of 4 mg/mL solution of S-nicotine brought about by the addition of lactic acid, according to certain embodiments of the present disclosure.

The circular dichroism (CD) spectrum of the unaltered E-liquid was obtained using a CD spectrometer (Chirascan V100, Applied Photophysics Ltd) under the following conditions: 300-190 nm (nanometer), 1 nm wavelength steps, 4 s per time point, 0.01 mm cell path length (Suprasil, Hellma, UK). CD spectra are shown in FIGS. 3 and 4.

The treatment of E-liquid with carbon dioxide gas 50 mL of the E-liquid was placed in a 100 mL impinger tube. The inlet of the impinger was connected by tubing to a small cylinder of pressurized carbon dioxide. The outlet of the impinger vented to atmosphere. The release of gas was controlled by a push activated valve and the cylinder was labelled to obtain 16 g of carbon dioxide. Approximately 5 g of carbon dioxide gas was passed through the E-liquids contained within the impinger. Following this 1 mL of the E-liquid was carefully removed from the impinger (twice), diluted with water and the pH was determined as described above.

The pH was found to be: 7.48 (24.8° C.) and 7.50 (24.5° C.). The mean pH was 7.490.

The remaining E-liquid in the impinger was subjected to the further passage of carbon dioxide gas. It was estimated that approximately 10 g of carbon dioxide transmitted through the E-liquid; some of the gas was lost to the atmosphere before passing through the E-liquid caused by leakage. Following this a further 1 mL of E-liquid was removed from the impinger (twice), diluted with water and the pH was determined as described above.

The pH was found now to be: 6.90 (24.5° C.) and 7.00 (24.8° C.). The mean pH was 6.950.

The CD spectrum of this carbon dioxide treated E-liquid was obtained, CD results are presented in a separate section below.

pH Results and Interpretation

The passage of carbon dioxide gas through the E-liquid reduced the measured pH of E-liquid (measured following aqueous dilution) from 9.395 to 7.490, and following subsequent further treatment to pH 6.950, mean of two replicate measurements. This shows that carbon dioxide gas does cause acidification of bulk E-liquid. It would be expected to have similar property in an aerosol where E-liquid droplets are bathed in air fortified with enhanced carbon dioxide. In an aerosol the total surface area of contact between E-liquid droplets and the surrounding gas phase would be larger than total surface area of contact between E-liquid and the bubbles of carbon dioxide passing through the E-liquid in the impinger. For that reason it is understood that carbon dioxide gas is able to acidify the E-liquid aerosol droplets and thereby protonate nicotine which resides predominantly within droplets. This acidification/protonation of nicotine is expected to reduce the small but finite amount of nicotine present in the gas phase which causes sensorial irritation and throat catch. Hence acidification/protonation of nicotine by carbon dioxide as described will produce an aerosol which is less harsh and smoother sensorially.

CD Results and Interpretation

FIG. 3 shows the CD spectra of: propylene glycol solvent (red), untreated 4 mg/mL 5-nicotine in propylene glycol (blue) and carbon dioxide treated 4 mg/mL S-nicotine in propylene glycol (green)

The CD spectra show that carbon dioxide treatment of the E-liquid reduces the CD signal at maxima at 271, 264, 245 and 208 nm. The spectra show the chemical environment of S-nicotine has been is affected by the carbon dioxide treatment.

FIG. 4 shows the CD spectra of: propylene glycol solvent (green), untreated 4 mg/mL 5-nicotine in propylene glycol (blue) and 4 mg/mL S-nicotine in propylene glycol after addition of lactic acid (10 μL R, S-lactic acid 85%, 15% water) added to 5 mL 4 mg/mL S-nicotine in propylene glycol).

Reductions in signal maxima were observed at 271, 264, 245 and 208 nm; this is similar to the carbon dioxide treatment of the E-liquid indicating that in both cases nicotine in propylene glycol solution is being protonated.

These results concur with observations made of nicotine in aqueous solution following acid-base titration (Peter M Clayton, Carl A. Vas, Tam T T Bui, Alex F. Drake and Kevin McAdam in *Analytical Methods,* 5 81-88 (2013)—'*Spectroscopic investigations into the acid-base properties of nicotine at different temperatures*').

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. A method of generating an aerosol comprising protonated nicotine, the method comprising the steps of:

(i) providing a nicotine formulation comprising nicotine as a free base form;

(ii) providing a carbon dioxide source capable of providing carbon dioxide in situ;

(iii) vaporizing or aerosolizing the nicotine formulation;

(iv) providing carbon dioxide from the carbon dioxide source; and (v) contacting the carbon dioxide with the vaporized or aerosolized nicotine formulation to thereby protonate nicotine free base and generate an aerosol comprising protonated nicotine;

wherein the nicotine formulation contains the carbon dioxide source.

2. The method according to claim 1, wherein the nicotine formulation contains nicotine substantially in free base form.

3. The method according to claim 1, wherein the nicotine formulation further comprises a carrier.

4. The method according to claim 3, wherein the carrier is a solvent.

5. The method according to claim 4, wherein the solvent is selected from glycerol, propylene glycol, 1,3-propane diol and mixtures thereof.

6. The method according to claim 1, wherein the nicotine formulation further comprises water.

7. The method according to claim 1, wherein the nicotine formulation comprises nicotine in an amount of no greater than 2 wt % based on the total weight of the formulation.

8. The method according to claim 1, wherein the nicotine formulation comprises nicotine in an amount of no greater than 1.8 wt % based on the total weight of the formulation.

9. A nicotine delivery system comprising:

(i) a nicotine formulation comprising nicotine as a free base form; and (ii) a carbon dioxide source that comprises carbon dioxide in the liquid or gas phase capable of providing carbon dioxide in situ to the nicotine formulation;

wherein the nicotine formulation contains the carbon dioxide source.

10. The nicotine delivery system according to claim 9, wherein the carbon dioxide source comprises carbon dioxide in the gas phase.

11. The nicotine delivery system according to claim 9, wherein the carbon dioxide source comprises carbon dioxide in the liquid phase.

12. The nicotine delivery system according to claim 9, where the nicotine formulation further comprises a carrier that is a solvent selected from glycerol, propylene glycol, 1,3-propane diol and mixtures thereof.

* * * * *